US008387284B2

(12) United States Patent
Baum

(10) Patent No.: US 8,387,284 B2
(45) Date of Patent: Mar. 5, 2013

(54) FOOTWEAR, CLOTHING AND OTHER APPAREL WITH INTERCHANGEABLE TOE AND HEEL MEMBERS OR OTHER ORNAMENTS AND RELATED METHODS AND SYSTEMS

(76) Inventor: Asher Baum, Brooklyn, NY (US)

( * ) Notice: Subject to any disclaimer, the term of this patent is extended or adjusted under 35 U.S.C. 154(b) by 548 days.

(21) Appl. No.: 12/497,233

(22) Filed: Jul. 2, 2009

(65) Prior Publication Data

US 2010/0005686 A1 Jan. 14, 2010

Related U.S. Application Data

(60) Provisional application No. 61/078,429, filed on Jul. 6, 2008.

(51) Int. Cl.
*A43B 3/24* (2006.01)
*A43B 5/00* (2006.01)
*A43B 23/00* (2006.01)

(52) U.S. Cl. ..... 36/100; 36/136; 36/72 B

(58) Field of Classification Search ..... 36/100, 36/101, 92, 132, 136, 138, 72 B, 69, 77 R
See application file for complete search history.

(56) References Cited

U.S. PATENT DOCUMENTS

| | | | | |
|---|---|---|---|---|
| 1,701,018 | A * | 2/1929 | Smart | 36/72 B |
| 2,076,514 | A * | 4/1937 | Huffman | 36/34 B |
| 2,088,976 | A * | 8/1937 | Resnik | 36/55 |
| 2,160,768 | A * | 5/1939 | Wasser | 36/72 R |
| 2,583,826 | A | 1/1953 | Fischer | |
| 3,256,620 | A * | 6/1966 | King | 36/92 |
| 4,441,264 | A * | 4/1984 | Hantz-Guibas et al. | 36/72 B |
| 4,484,397 | A * | 11/1984 | Curley, Jr. | 36/92 |
| D368,356 | S | 4/1996 | Reale | |
| D399,643 | S | 10/1998 | Harbison | |
| 6,052,924 | A | 4/2000 | Sabat | |
| 6,212,797 | B1 | 4/2001 | Merry et al. | |
| 6,385,865 | B1 | 5/2002 | Jang et al. | |
| 6,640,467 | B1 | 11/2003 | Krull | |
| 6,898,873 | B2 | 5/2005 | Schenone | |
| 7,059,070 | B2 | 6/2006 | Omstead et al. | |
| 7,107,707 | B2 | 9/2006 | Schenone | |
| 7,117,616 | B2 | 10/2006 | Hull | |
| 7,441,348 | B1 | 10/2008 | Dawson | |
| 7,814,685 | B1 * | 10/2010 | Tankson | 36/72 B |
| 2005/0005478 | A1 | 1/2005 | James | |
| 2005/0016028 | A1 | 1/2005 | Safdeye | |
| 2005/0138846 | A1 * | 6/2005 | O'Connor | 36/72 B |
| 2007/0130802 | A1 | 6/2007 | Condie | |
| 2008/0022558 | A1 | 1/2008 | Kaufer | |
| 2008/0086915 | A1 | 4/2008 | Cox et al. | |
| 2010/0000126 | A1 | 1/2010 | Ortner | |

(Continued)

OTHER PUBLICATIONS

International Search Report for PCT/US2009/049569, Sep. 1, 2009.

*Primary Examiner* — Jila M Mohandesi
(74) *Attorney, Agent, or Firm* — Israel Nissenbaum; Yitzy Nissenbaum

(57) ABSTRACT

A method for providing changeable designs on clothing such as shoes by integrating a portion of the outer surface of an existing article of the shoe with a base anchor, and a system therefor. A selected ornamentation is placed on the shoe at the site of the base anchor. The ornamentation is integrated with an attachment for cooperative releasable fastening engagement with the anchor. The ornamentation is releasably fastened to the outer surface of the shoe by engaging the base anchor with the attachment of the ornamentation. The attachment and the base anchor provide the fastening of the ornamentation to the outer surface of the shoe substantially without intervening fastening elements, between the ends of the ornamentation and the outer surface of the shoe, which space the peripheral ends from the shoe. The engaging between the base anchor with the ornamentation is positioned as not being externally visible.

21 Claims, 11 Drawing Sheets

U.S. PATENT DOCUMENTS * cited by examiner

2010/0170113 A1 7/2010 Garza
2010/0186258 A1 7/2010 Garza

FOOTWEAR, CLOTHING AND OTHER APPAREL WITH INTERCHANGEABLE TOE AND HEEL MEMBERS OR OTHER ORNAMENTS AND RELATED METHODS AND SYSTEMS

RELATED APPLICATIONS

This application is related to and claims the benefit under 35 U.S.C. §119 of U.S. provisional patent application Ser. No. 61/078,429, entitled "Sneaker Design Personalizing," filed on Jul. 6, 2008, which is incorporated herein by reference in its entirety.

FIELD OF THE INVENTION

This invention relates to accessories or clothing, such as footwear, in particular to sneakers with, for example, interchangeable toe and heel design members. The interchangeable design members may, for example, display a logo or character, a particular color palette or be custom designed by or for a particular consumer or user.

BACKGROUND OF THE INVENTION

Decorative designs are highly desired in clothing and accessories. These desires are often manifested in the latest styles and fads, which are constantly changing. New designs define the state of what is "in" at the moment. Keeping up with these changes often requires large investments in ever changing clothing such as the latest jeans, tops, sneakers, and other modes of dress. There is a "hip" trend of being individualistic while at the same time following the latest fad. Athletic shoes or sneakers have a particular cachet in terms of appearance and the latest "cool" features, which engender a proprietary identification of the wearer. Cottage industries have arisen with respect to sneakers. Therefore, there is a need for customizable, trendy clothing, in particular, footwear.

Certain customizable sneakers are known, such as, for example, the NIKEiD® line of custom made sneakers. These shoes; however, are unitary and unchangeable once a consumer selects the various elements of design. Further, these shoes are manufactured upon order, thus, delaying consumer receipt for several weeks. The cost may also be prohibitive, for either a single pair or multiple pairs to meet consumer desire for a current trend.

Other customizable sneakers may have pasted or painted on designs, which tend to peel off, creating an unattractive appearance, or leave permanent residues on the footwear, which tend to discourage further changes.

Crocs® popular Jibbitz® charms are exemplary of removable items designed for and inserted into the existing proprietary ventilation holes on the uppers of Crocs® shoes. The Jibbitz® charms however require access to the shoe interior for removal and cannot be readily used with athletic shoes and sneakers of other types and manufacture. Since the Jibittz® charms require perforation in the shoes for attachment, they cannot be directly applied to the shoes at all and only as peripheral attachments, such as to shoelaces.

Therefore, there is a need for customizable footwear with interchangeable heel and/or toe members or other changeable modifications or accessories, allowing the consumer to make multiple desired fashion statements.

SUMMARY OF THE INVENTION

Various aspects and embodiments of the present invention, as described in more detail and by example below, address certain of the shortfalls of the background technology and emerging needs in the relevant marketplace.

It is accordingly an object of one or more embodiments of the present invention to provide individualistic, interchangeable heel and/or toe members or other accessories of varying shapes and colors which can be constantly changed, as desired on a base footwear, such as, for example, a sneaker.

It is further an object of the present invention to provide heel or toe members which are firmly affixed to the footwear using a fastening element, such as, for example, a tongue-and-groove slide mechanism. Complementary tongue-and-groove mechanisms may be provided on the footwear and the heel and/or toe member, providing a firm, yet removable engagement between the footwear and the heel and/or toe member.

A tongue-and-groove mechanism may be placed on either side of the heel of a sneaker and/or on or near the toe of the sneaker. The mechanism may be situated such that normal movement by the wearer, such as, for example, walking, running, or jumping that causes impacts, bending and/or stretching at flexure points on the footwear, does not interfere with the connection between the footwear and the heel and/or toe member.

The heel and/or toe member may also include a complementary tongue-and-groove portion on the inner side. The toe member may be configured to be distant from or resist toe creasing with forward movement; the heel member may be similarly configured to resist lateral and/or forward heel and ankle movement.

In an embodiment of the invention, the heel member may have an opening at the rear portion to allow a wedge on the heel of the sneaker to extend through it. This extension may provide additional stabilization and/or firm fixation for the heel member.

The heel and/or toe member may be made from a durable, yet flexible, material, such as, TPU synthetic, polypropylene, nylon, foam-like material, leather, synthetic leather and the like. The material may further be configured, for example, to exhibit changing colors, sports and entertainment logos and scenes, LED illumination or glow in the dark properties.

In another embodiment of the invention, other accessories such as, for example, wings may be clipped to the footwear in addition to or instead of the heel and/or toe member.

Alternate embodiments of the invention may include alternative or additional accessories such as, for example, tongue covers, clip-on soles, accessories that clip on straps used over or instead of laces, add on stripes or other such geometric shapes, and similar or additional items.

Additional embodiments of the invention include clip-on fixation devices that may be integral with the surface of the footwear, molded into the footwear, welded or otherwise applied to the footwear by adhesives, Velcro, magnets, stitching, rivets, grommets, screws, pins, zippers, hook-and-eye fasteners or other fixation or fastening mechanisms. The clip or other fastener, such as a binding, tongue-and-groove, biased binder, spring, Velcro, magnet, or screw and nut device may be located on the surface of the footwear, extend through it, fit into a pocket or sheath or fit into a box, extension, or flap on the footwear.

It is yet a further object of the present invention to provide an online service for selection of desired ornamentation of color, configuration and the like. Consumers may be able to design their footwear in accordance with their wardrobe in a more inexpensive way, with ease, versatility, flexibility and control that may embody uniqueness, style, empowerment, self expression and/or coordination.

It is accordingly another object of one or more further embodiments of the present invention to provide a method for the individualistic personal aesthetically pleasing ornamental designing and design changing of substantially any article of clothing or apparel and particularly of athletic shoes and sneakers. Ornamental adornments of varying shapes and colors, which can be user selected and constantly changed, as desired, may be readily placed and replaced, and aesthetically maintained on clothing and particularly on base footwear sneakers.

It is a further object of certain embodiments of the present invention wherein the method enables a sneaker wearer to individualize the appearance of the sneaker to an ever changing trendy look, even while wearing the sneaker It is a further object of one or more embodiments of the present invention to provide sneakers and similar fashion statement type footwear with anchoring elements solidly or, for example firmly affixed to the surface of footwear. The anchoring elements may be configured for solid but removable engagement with a series or plethora of cooperative attachments integrated with varying individualistic decorative elements with varying designs and colors. The attachments may be readily removable from the anchoring elements for effecting change of decorative appearance but are provided with elements for resistance to unintended removal. The anchor elements and attachments may be either positioned on the footwear at positions not affected by bending and stretching with flexure points resulting from walking or running and concomitant foot bending or are alternatively configured to aesthetically accommodate such bending and stretching with specific material selection and shape configuration.

It is a further object of certain embodiments of the present invention to particularly provide attachments in the form of toe ornamentation and heel wrappings. The toe ornamentation may be configured to be distant from or to resist the toe creasing with forward movement and the heel wrapping may be similarly configured to resist lateral and forward heel and ankle movement.

It is yet a further object of one or more embodiments of the present invention to provide an optional on-line service for selection ordering of desired ornamentation of color, configuration and the like whereby sneaker wearers are able to design decorative ornamentation for their footwear in accordance with their wardrobe in a more inexpensive way, with ease, versatility, flexibility and control and embodies uniqueness, style empowerment, self-expression and coordination.

The present invention may further include, for example, a system and method for the changeable and user selectable placement and replacement of ornamental designs on clothing and particularly athletic shoes and sneakers. The method may include, for example, the steps of:

a) non-removably or, for example, fixedly integrating at least one portion of the outer surface of an existing article of clothing, such as a sneaker, with at least one base anchoring element ("non-removably", as used herein, means not readily removable), examples of non-removably integrating include, for example, sewing, stapling, riveting and non-releasable gluing;
b) selecting and configuring at least one element, for example of a decorative ornamentation element variety, for placement, for example in a decorative placement arrangement, on the article of clothing at the site of the at least one of the base anchoring element;
c) integrating the at least one element, for example a decorative ornamentation element, with an attachment element configured for, for example, cooperative releasable engagement with the anchoring element (the term "integrating", as use herein, may include, for example, initial formation of the ornamentation element with the attachment element);
d) releasably attaching, for example, the decorative ornamentation element to the outer surface of the article of clothing by, for example, engaging the base anchoring element with the attachment element of the decorative ornamentation element; and
e) utilizing at least one mechanism to ensure that the exemplary decorative ornamental element is, most preferably, for example, not degraded or, for example, reduced in degradation in ornamental appearance during use of the article of clothing.

It is preferred for example, in one or more exemplary embodiments, in this latter step that the peripheral ends of the decorative ornamentation element be, for example, configured to closely engage the outer surface of the article of clothing to enhance the aesthetic appearance of the decorative ornamentation element on the article of clothing and to reduce incidence of accidental separation between the decorative ornamentation element and the outer surface of the article of clothing.

In certain alternative embodiments, the step of selecting and configuring at least one decorative ornamentation element is effected by choosing from an on-line availability of selectable ornamentation from a menu of colors, configurations and the like.

In a further alternative embodiment the decorative ornamentation element and the base anchoring element may be configured to conform to normal contour and movement of the article of clothing such as a sneaker to provide and maintain an aesthetic appearance without or minimizing cracks, peeling, warping and the like. The portion of the outer surface to which the base anchor element and the decorative ornamentation element are affixed may, for example, be evaluated according to shape and movement and the anchor element and ornamentation element may be conformed thereto in both material (e.g. elastic to accommodate clothing movement or rigid, as required) and shape, e.g., with expected compensatory curvature. It is understood that there need not be a one to one relation between base anchoring elements and decorative ornamentation elements. Several base anchoring elements may be used to support, for example, with close registration, elongated or larger decorative ornamentation elements and, with less frequency, a single base anchoring element may be of sufficient extent to support and maintain several decorative ornamentation elements.

The present invention further may include in certain embodiments, a system of user selectable decorative ornamentation comprising at least one base anchoring element and configured for non removable or fixed attachment or integration with an article of clothing, such as a sneaker, and at least one decorative ornamentation element having an attachment element configured for cooperative engagement with the base anchoring element.

These and other objects features and advantages of the present invention will become more evident from the following discussion and drawings in which:

DETAILED DESCRIPTION OF THE INVENTION

Figure 1:
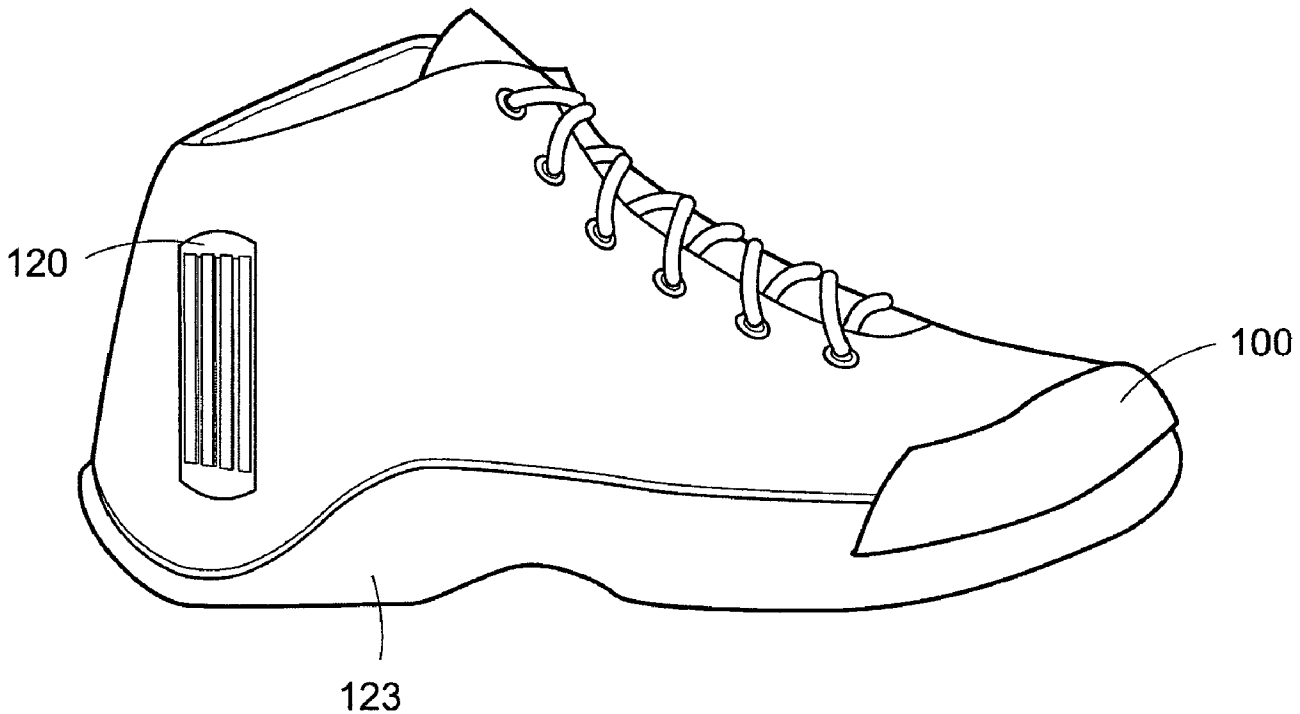
FIG. 1 is a side view of a sneaker showing an embodiment of the invention having a vertically positioned fastening element for placement of a heel member thereon and a toe member in place.

It is to be understood that the present invention is not limited to the particular methodology, compounds, materials, manufacturing techniques, uses, and applications described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures.

All patents and other publications identified are incorporated herein by reference for the purpose of describing and disclosing, for example, the methodologies described in such publications that might be used in connection with the present invention. These publications are provided solely for their disclosure prior to the filing date of the present application. Nothing in this regard should be construed as an admission that the inventors are not entitled to antedate such disclosure by virtue of prior invention or for any other reason.

The present invention offers a high level of individuality, control and self expression by introducing an additional member to the custom designed performance shoe in the form of a portable, and easily changeable toe and/or heel member by virtue of various preformatted fashion driven designs/logos or custom designs, which change the "look" and "style" as often as desired. This enables a consumer to achieve a "Signature Look" by personalizing his/her wardrobe with, for example, a web or store based selection of assorted designs/logos. Inherent in the concept of various embodiments of the invention are dozens of coordination possibilities with a minimal purchasing investment of the reasonably priced, web or store based assortment of heel and/or toe design members.

Generally the present invention may include, for example, changeable toe and/or heel design members on footwear, particularly sneakers, or other clothing accessories, which are securely fastened to, for example, a sneaker substrate with one or more interlocking tongue-and-groove mechanisms and preferably may include a positive snap-on placement. The placement of an accessory may be possible while the sneaker is being worn; no sneaker interior access is necessary. The present invention may further include a process or system for online availability or selection and ordering of selectable ornamentation from a menu of colors, configurations and the like.

The following discussion relates, for example, to footwear and particularly athletic shoes and sneakers as being exemplary of the present invention but is not limited thereto and which footwear is particularly subject to movements and stresses requiring accommodating expedients. However, apparel and clothing in general such as jeans, shirts, tops, belts and worn accessories such as eyeglasses may also be ornamentally designed and adorned with the same or similar method and elements.

Because aesthetics of ornamentation design changes may, for example, be highly dependent on, in certain instances or embodiments, accurate placement it may initially be important in certain embodiments that the base anchor element on the surface of the sneaker and the attachment element of the ornamental design element be compatible with and in close registration with each other for precise engagement. Thus, although a variable attachment such as between hook and eye elements may be sufficient and aesthetically acceptable for placement of "floating" design ornaments ("floating" being a placement generally unrelated to the sneaker substrate structure), it may, in certain embodiments, be preferred that close fitting tongue in groove, slide elements, snap together elements and the like be utilized for ornamental designs which may, for example, line up with actual sneaker structural components.

One or more ornaments may, for example, be held in place on a sneaker by snapping action closely conforming the edges of an attachment or ornamental elements to further prevent or reduce movement during use and maintain, for example, a tight and pleasing appearance. Removal of such elements may be effected by reversing the process, and sliding or snapping the ornament off.

Figure 2:
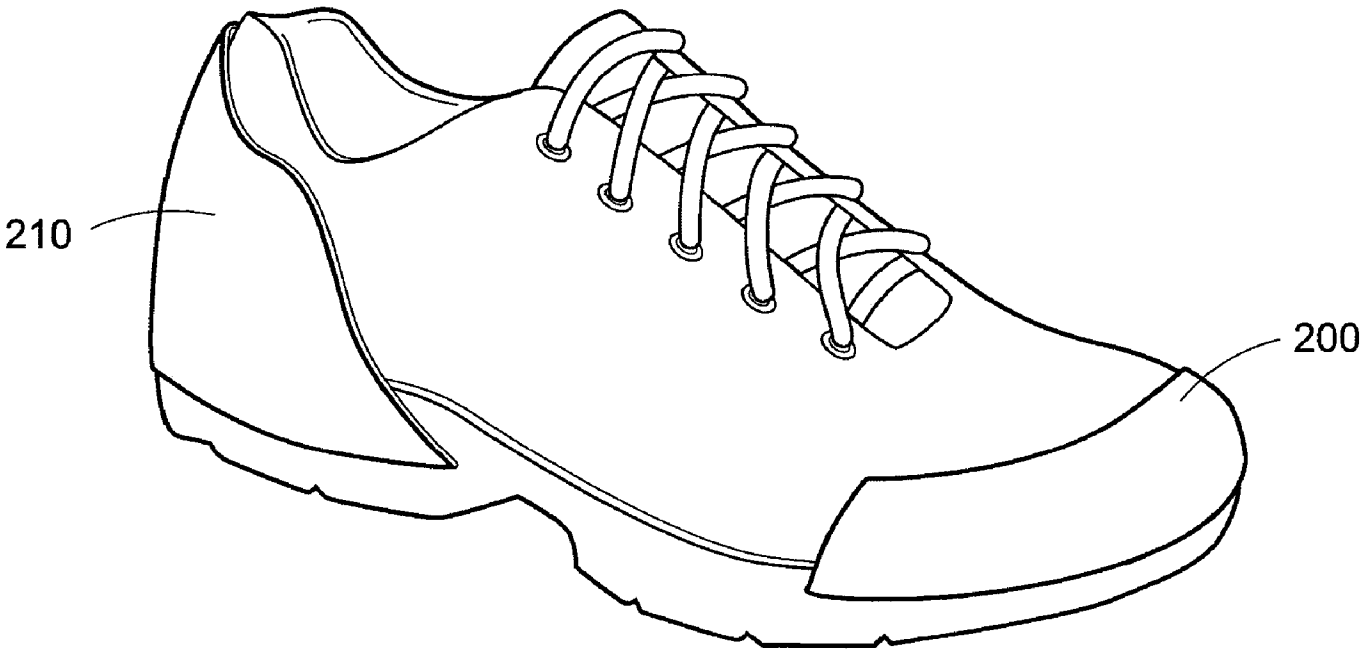
FIG. 2 is a side perspective depiction of one embodiment of the invention with the heel and toe members in place on a sneaker.

FIG. 1 depicts an embodiment of a sneaker with a toe member 100 in place. The interlocking tongue-and-groove mechanism 120 is, in this example, vertically integrated into the sneaker. The tongue-and-groove mechanism 120 may alternatively be fitted into a pocket or sheath to affix the mechanism in a stable location. The mechanism may further be affixed within an indentation on the sneaker upper to provide for a more snug fit of the toe and/or heel design member over the sneaker. An indentation 123 in the sneaker may more positively provide for the accurate placement of the tongue-and-groove mechanism 120. In the embodiment of FIG. 2, both the toe member 200 and heel member 210 are in place on a sneaker.

Alternatively, the tongue-and-groove mechanism may be glued on to the shoe, fixed by magnet, Velcro, rivet(s), pins, screws, grommets, welds, zippers, stitching, sewing or other fixation methods. Other alternatives to the tongue-and-groove clip, or in addition to it, include binder clips, spring clips, screws, pins, Velcro, adhesive, epoxy, zippers, removable clasps or added fabric flaps with one or more of these or other fasteners attached thereon or thereto. The clip, tongue-and-groove, binder or other fastener may be located on the outer surface of the footwear, be located under or on a flap of material affixed to the footwear, or hidden inside the surface of the footwear by, for example, a zipper, flap or pocket.

In one embodiment of the tongue-and-groove clip depicted in FIG. 1, the portions of the clip affixed to the heel and/or toe member slide into and thereby interlock with the complimentary recesses on the clip portion affixed to the footwear. Alternative interlocking, tongue-and-groove, or male-female connectors may be used in addition to or instead of the embodiment of the clip depicted in FIGS. 1 and 3*a*-3*d*. The grooves in the clip may also be oriented vertically or horizontally or at any diagonal. The groves may also comprise a single groove or curve or other complimentary shape such as a ball bearing and socket interface, a snap-on circle and expanding tubular section in a grove, a ball seal, or other such devices and may also include additional retaining rings, clips, pins, screws, springs, Velcro or other such fasteners.

Figure 3A:
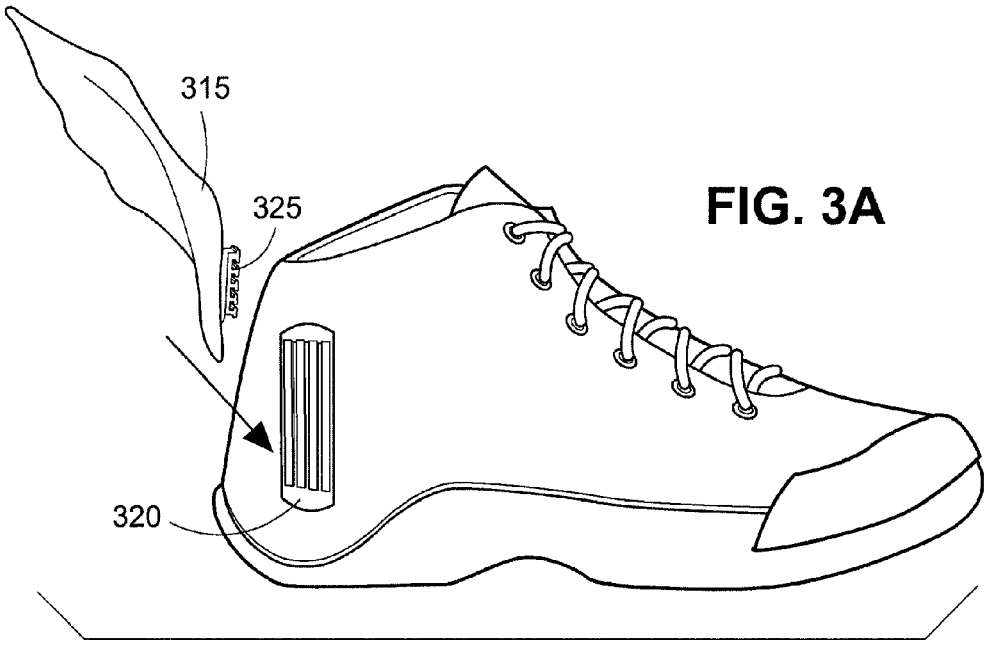
FIGS. 3*a*-3*b* depict an embodiment of the invention with a heel member in the shape of a wing.
Figure 3B:
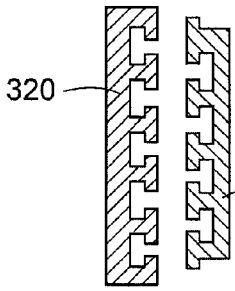
Figure 3C:
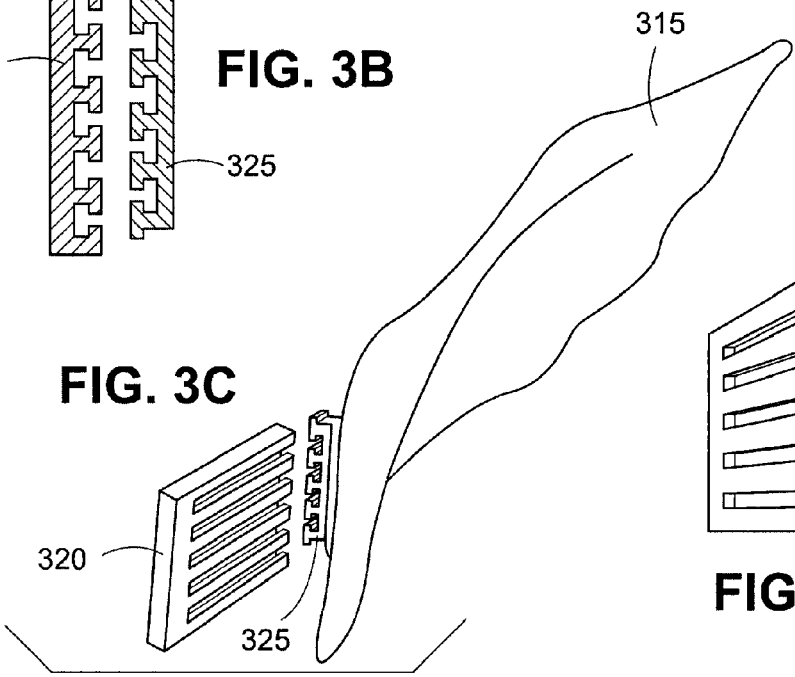
FIGS. 3*c*-3*d* are top and perspective views of the fastening element of the present invention.
Figure 3D:
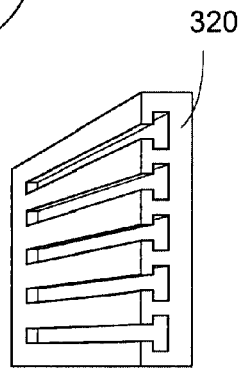

In another alternative embodiment, the heel design member may be a shaped attachment, such as, for example, a wing, or one or more wings may be applied in addition to a heel member or toe member or at another location on the footwear. FIGS. 3*a* and 3*b* show a wing heel design member 315 being inserted into the tongue-and-groove mechanism 320. The corresponding, interlocking mechanism 325 is visible on the wing heel design member 315. FIGS. 3*c* and 3*d* show the tongue-and-groove mechanism 320 and corresponding, interlocking mechanism 325, which fit together to secure the toe and/or heel design member to the sneaker.

Figure 4A:
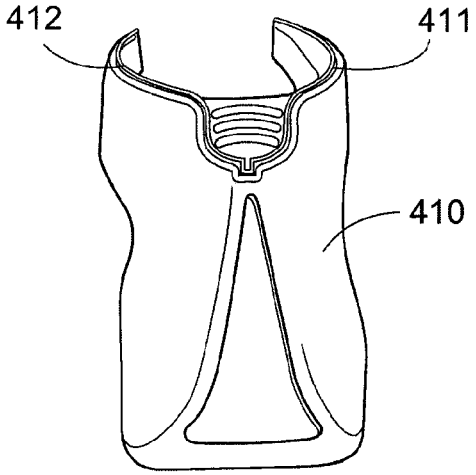
FIGS. 4*a*-4*e* depict an embodiment of the invention with a heel member affixed with exemplary fastening elements and further stabilized by the protrusion of a wedge through the heel member.
Figure 4B:
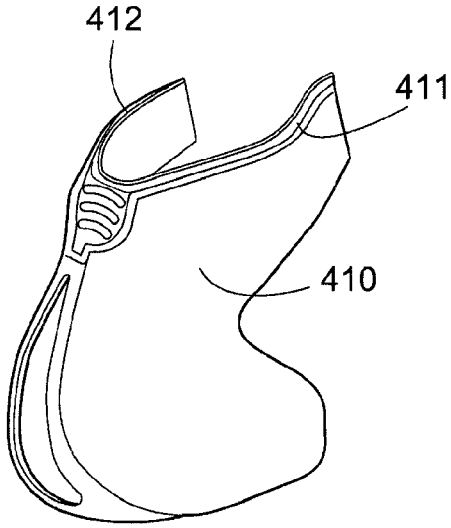
Figure 4C:
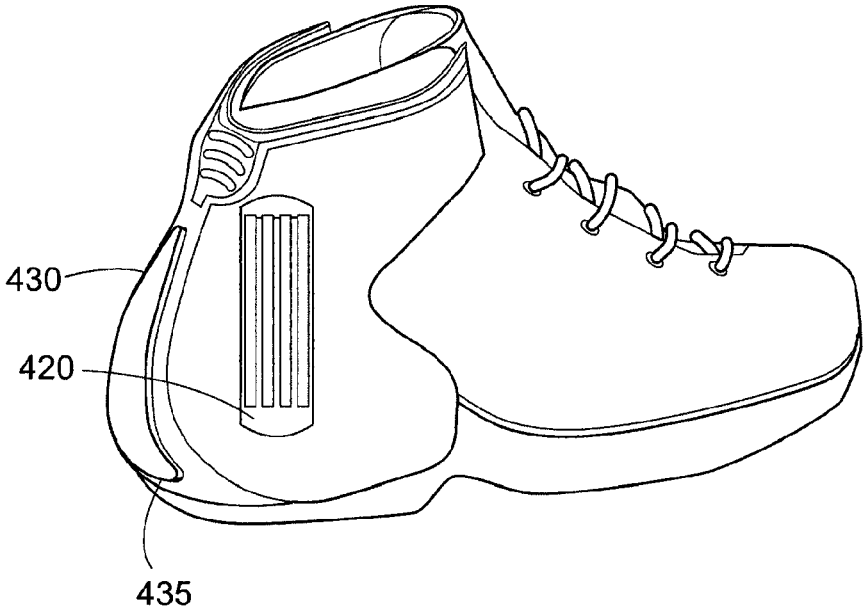
Figure 4D:
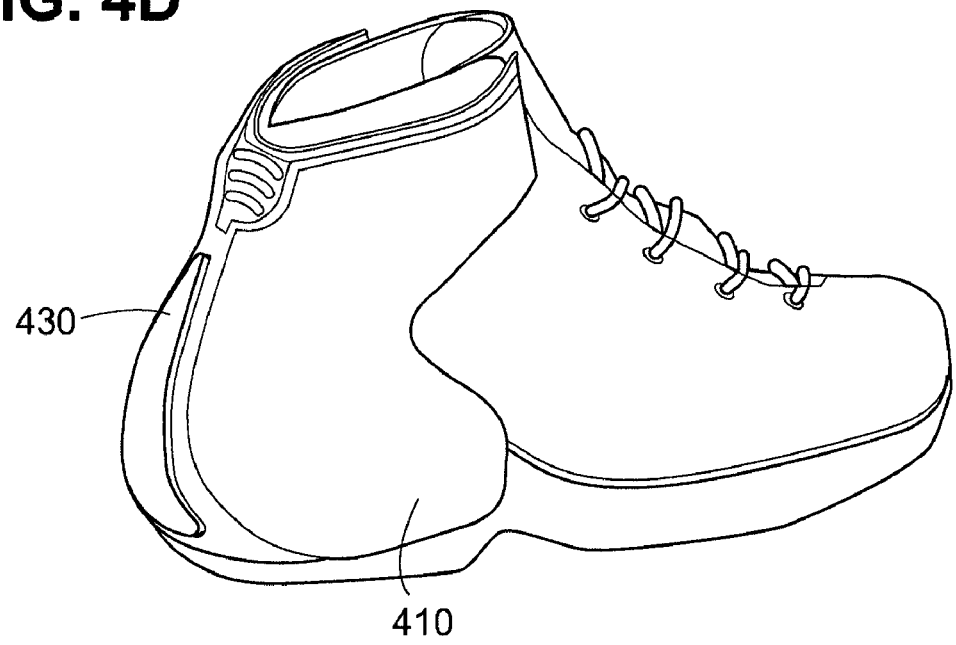
Figure 4E:
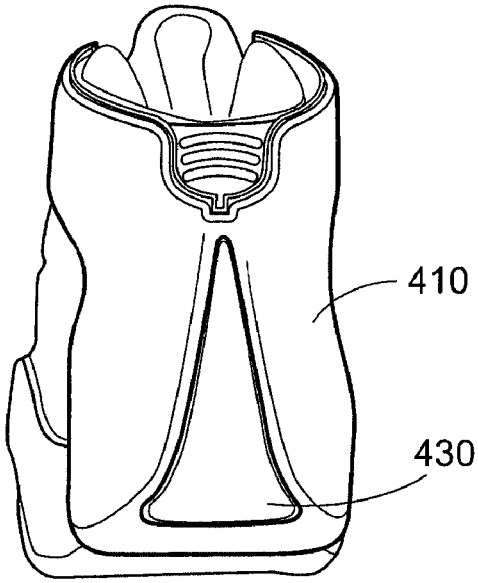

FIGS. 4*a*-4*e* show another alternative embodiment of the invention. In this embodiment, a sneaker may have a rear protrusion or wedge 430 that is captured and/or otherwise accommodated within a cutout of the heel design member 410, thereby resisting lateral movement and/or providing additional fixation or stability. FIGS. 4*b* and 4*d* show a perspective view of the heel design member 410 with and without the wedge 430 captured. Alternately, a notch 435 may be made under wedge 430 to further provide stability to the heel design member 410. The wedge may be attached to the outsole as shown in the figures or it may be a separate element that is added to the construction of the sneaker or footwear. Sides 411 and 412 of the heel design member 410 may spread apart while the heel design member 410 is engaged to the shoe via, for example, the tongue-and-grove mechanism 420 and/or the wedge 430. Other parts may protrude from the shoe or sneaker with the toe and/or heel design member being configured to retain the protrusion as a fixing element. Alternatively, the heel and/or toe member may be retained solely by a wedge or other protrusion without the need for an added tongue-and-groove or other fastener.

Figure 6B:
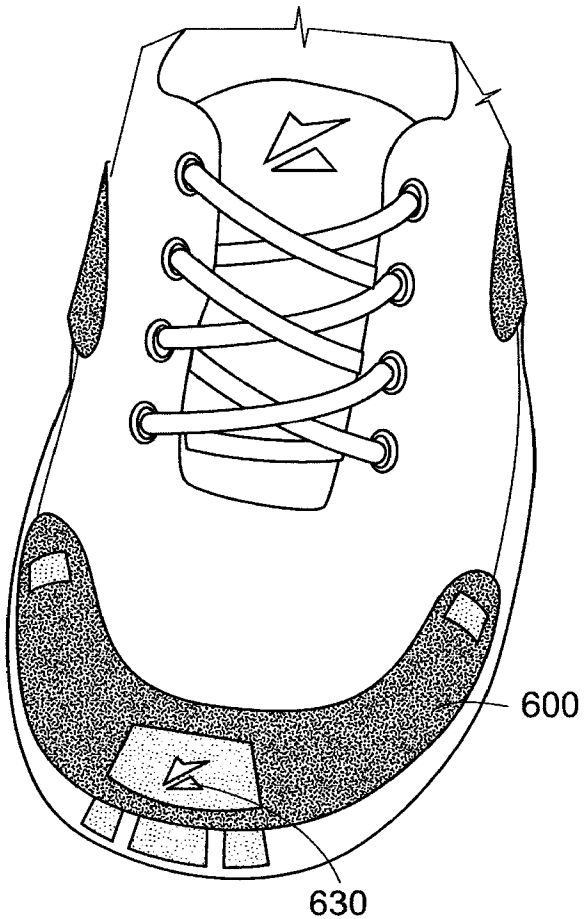
FIGS. 6*a*-6*b* depict an embodiment of the invention showing exemplary fastening elements on the toe of a shoe and a toe element affixed to the fastening elements.
Figure 6A:
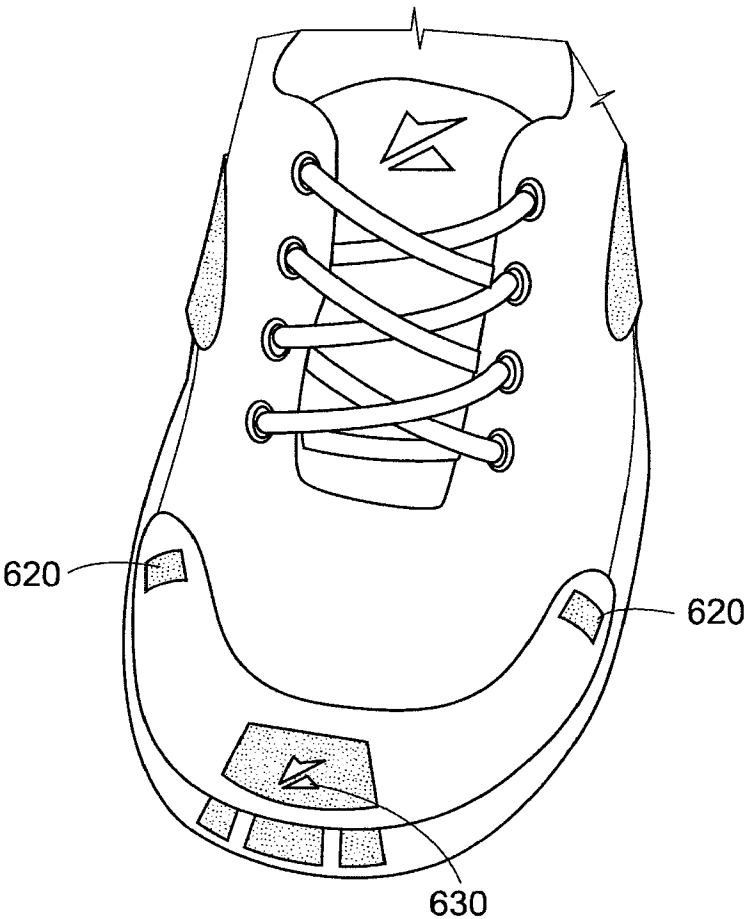
Figure 7B:
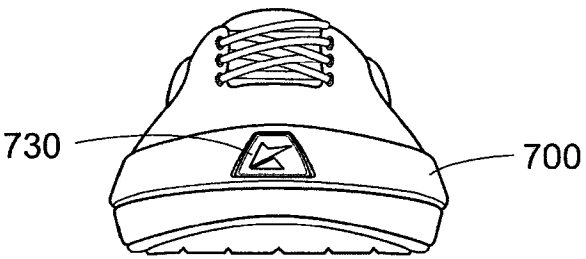
FIGS. 7*a*-7*c* depict embodiments with further exemplary toe members.
Figure 7A:
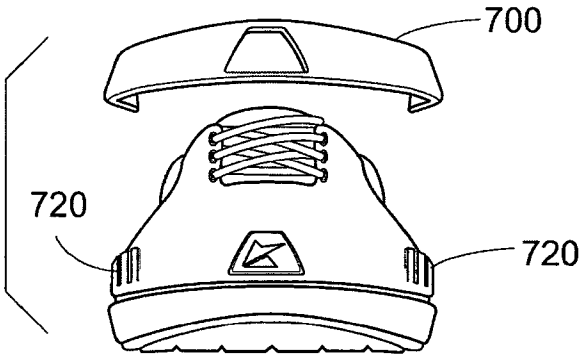
Figure 7C:
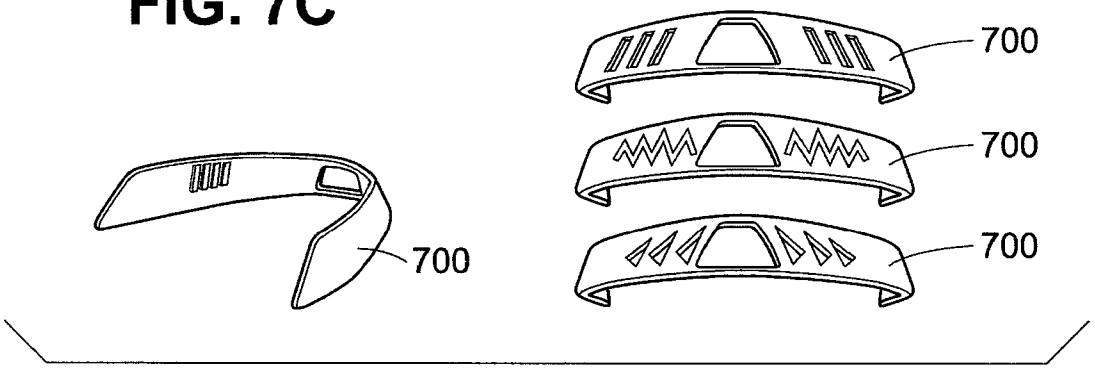

FIGS. 6*a*-6*b* show a further alternative embodiment of the invention. The sneaker may have a front protrusion or wedge 630 that is captured by and/or otherwise accommodated within a cutout of the toe design member 600. This wedge may provide additional fixation or stability to the toe design member. The toe design member 600 may include, for example, a tongue-and-groove fastener on the underside (not visible) which mates with one or more tongue-and-groove fasteners 620 on the sneaker. FIGS. 7*a*-7*b* provide a front view of this alternative embodiment in which the toe design member 700 is attached using, for example, a tongue-and-groove fastener 720. Various toe design members 700 are shown in FIG. 7*c*.

Figure 8:
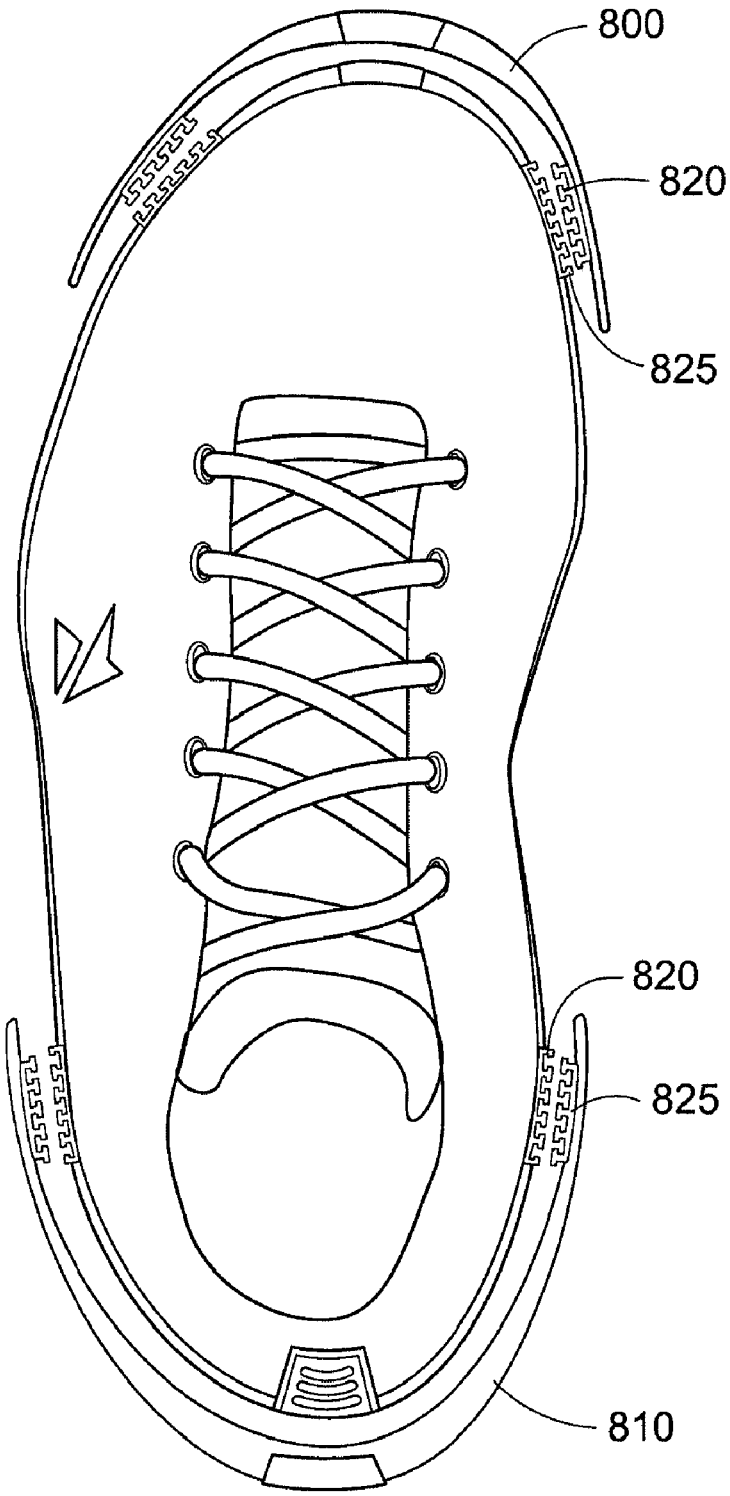
FIG. 8 is a top view of an embodiment of the present invention.

FIG. 8 is a top view of an embodiment of the invention in which a heel design member 810 and a toe design member 800 may be affixed to a sneaker using a tongue-and-groove mechanism 820 on both the heel design member 810 and the toe design member 800 which mate with one or more tongue-and-groove mechanisms 825 on the sneaker.

One or more tongue-and-groove mechanisms or alternative fasteners may be positioned on each side of the heel part of the shoe for larger heel design members that may extend around the shoe. A similar type of tongue-and-groove mechanism or alternative fastener may be applied to the front of the shoe or toe section. The tongue-and-groove mechanism preferably includes a vertical placement to allow slipping of a toe and/or heel design member down onto it without displacement during use. Alternatively, the tongue-and-groove mechanism may be horizontal but with a placement locking element to prevent unwanted accidental displacement.

The toe and/or heel design member may be made out of a durable, yet flexible material, such as TPU synthetic (e.g., silicone like material), polypropylene, nylon, foam-like material, patent leather, fake leather, and the like. The toe and/or heel design member may have a firm shape to it or, for example, otherwise be resilient; which may be developed through mold injection, or other methods. The toe and/or heel design member may further include a small extending tab to facilitate removal. For outré ornamentation, the toe and/or heel design member may be configured or material selected to glow in the dark, to be illuminated with LED light, to provide the appearance of changing colors, or to be adorned with recognizable sports and entertainment logos or scenes or any other suitable mark, insignia or design.

As part of the system of an embodiment of the invention, complimentary customer service on a web site may be provided, that may, for example, provide technical or non technical consultation. Alternatively, this service may be provided on a fee basis. In addition, the website may be designed to be, for example, an interactive experience to accommodate, for example, younger consumers, and may incorporate a "design my line" aspect that may encourage individuality and/or creativity, as well as, for example, potentially providing the ability to make future purchases to augment an existing line of footwear.

Figure 5A:
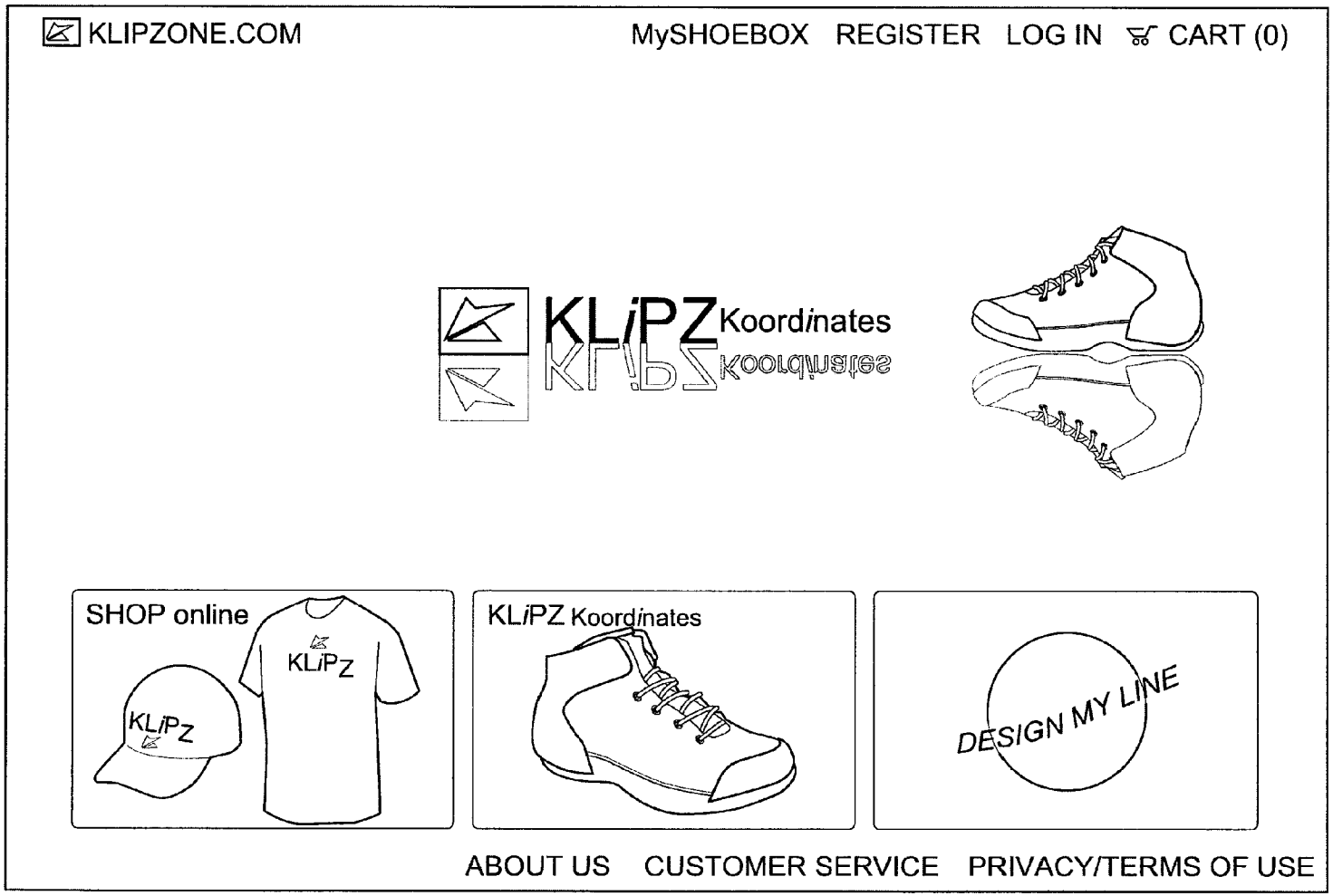
FIGS. 5*a*-5*c* are screen captures of an embodiment of an online system of the present invention.
Figure 5B:
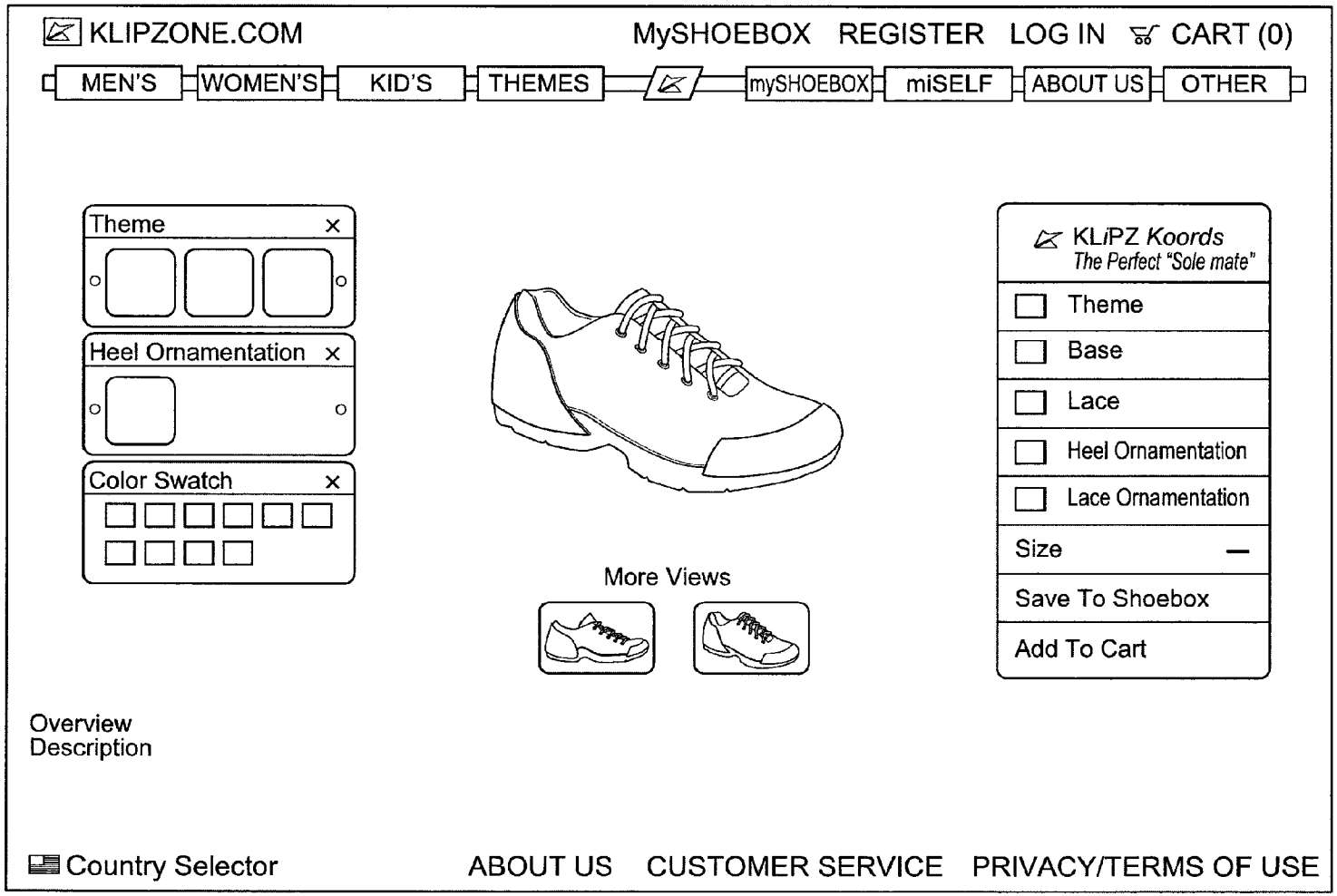
Figure 5C:
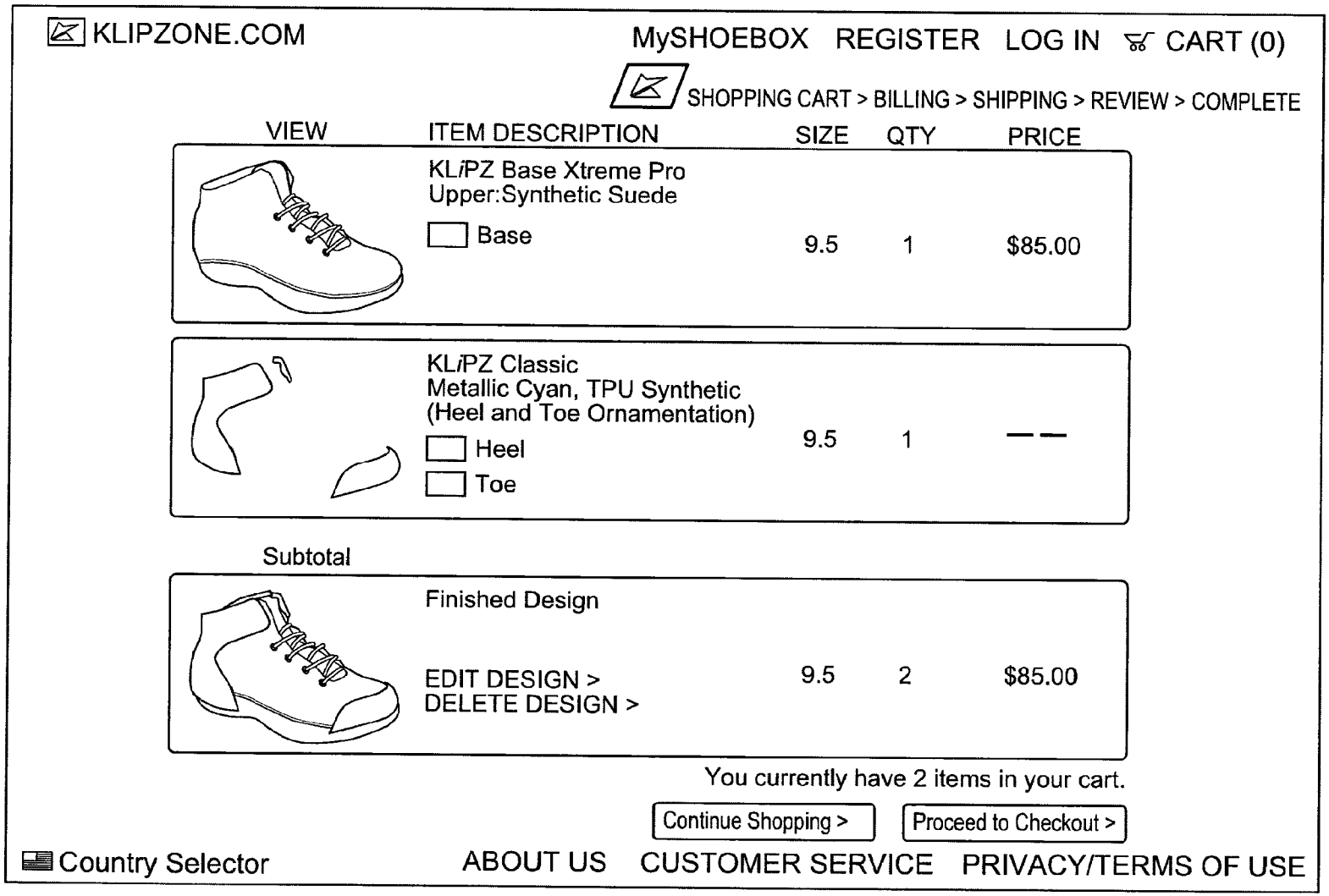

As shown, for example, in FIG. 5*a*, a user friendly web-link called, for example, "design my line," may be provided where one may design a shoe with various attachments to allow customers to color coordinate their apparel in advance of a purchase. This system also may include the functionality to save creations made by the user for ordering at a later date. FIGS. 5*b* and 5*c* are representative screen captures, wherein a consumer may, for example, select the heel and/or toe design member and may also further customize the color, theme and other aspects of the sneaker.

The embodiments described above are exemplary only. One skilled in the art may recognize variations from the embodiments specifically described here, which are intended to be within the scope of this disclosure. As such, the invention is limited only by the following claims. Thus, it is intended that the present invention cover the modifications of this invention provided they come within the scope of the appended claims and their equivalents.

What is claimed is:

1. A method for providing changeable items of design on clothing, the method comprising the steps of:

a) covering and integrating at least one portion of an outer surface of an existing article of clothing with at least one base anchoring element having at least one fastening element thereon;

b) selecting at least one changeable ornamentation element for placement on the article of clothing at a site of the at least one of the base anchoring element;

c) providing the at least one ornamentation element with an attachment element configured for cooperative releasable fixed fastening engagement with the at least one fastening element of said base anchoring element, the attachment element being positioned on an inner surface area of the ornamentation element distanced from peripheral ends of the ornamentation element;

d) providing the attachment element with elements configured to provide both lateral and vertical resistance to prevent unintended removal of the ornamentation element from the fixed fastening engagement; and e) releasably fixedly attaching said ornamentation element to the outer surface of the article of clothing by fixed fastening engagement of the at least one fastening element of the base anchoring element with the attachment element of the ornamentation element.

2. The method of claim 1, wherein the article of clothing is footwear.

3. The method of claim 2, wherein the ornamentation element is at least one of a heel and toe decoration wherein the heel and toe decorations are configured to wrap around the respective heel and toe of the footwear.

4. The method of claim 2, wherein the ornamentation element is a heel decoration having an aperture therein configured to capture a portion of the heel of the footwear to prevent relative movement between the heel decoration and the footwear.

5. The method of claim 2, wherein the at least one fastening element of the base anchor element and attachment element comprise a tongue in groove attachment configuration.

6. The method of claim 2, wherein the ornamentation element comprises a material which compensates for movement of the footwear therebeneath resulting from use.

7. The method of claim 2, further comprising conforming said ornamentation element to a portion of a specific structure of the footwear.

8. The method of claim 1, wherein the selecting of the at least one ornamentation element for placement on the article of clothing at the site of the at least one of the base anchoring element is effected by selection of an ornamentation element or ornamental characteristics of an ornamentation element from a selection listing on an on-line web site.

9. The method of claim 1, wherein the peripheral ends are closely engaged with either the footwear or the base anchoring element.

10. The method of claim 9, further comprising closely engaging peripheral ends of said ornamentation element to the outer surface of the article of clothing to reduce incidence of accidental separation between the ornamentation element and the outer surface of the article of clothing.

11. The method of claim 2, wherein the footwear is a sneaker.

12. The method of claim 1, wherein the ornamentation element is configured to extend away from the base anchoring element with only the base anchoring element and the attachment element being in contact with or directly adjacent to each other.

13. A system of user selectable ornamentation comprising at least one base anchoring element configured for integration with and covering a portion of an outer surface of an article of clothing and having at least one fastening element, and at least one ornamentation element having an attachment element configured for fixed removable fastening engagement with said at least one fastening element of the base anchoring element, wherein the attachment element and the at least one fastening element of the base anchoring element are configured to provide the fixed fastening engagement of the ornamentation element to the outer surface of the article of clothing, the attachment element being positioned on an inner surface area of the ornamentation element distanced from peripheral ends of the ornamentation element; and the attachment element having elements configured to provide lateral and vertical resistance to prevent unintended removal of the ornamentation element from the fixed fastening engagement.

14. The system of claim 13, wherein said article of clothing comprises footwear.

15. The system of claim 14, wherein said ornamentation element comprises at least one of a heel and toe decoration wherein the at least one of a heel and toe decoration are configured to wrap around the respective heel and toe of the footwear.

16. The system of claim 15, wherein said ornamentation element comprises a heel decoration having an aperture therein configured to capture a portion of the heel of said footwear.

17. The system of claim 14, wherein the footwear is a sneaker.

18. The system of claim 13, wherein the peripheral ends are directly closely engaged with either the article of clothing or the base anchoring element.

19. The system of claim 13, wherein the peripheral ends are closely engaged with either the article of clothing or the base anchoring element.

20. The system of claim 19, wherein the peripheral ends are closely directly engaged with either the article of clothing or the base anchoring element.

21. The system of claim 13, wherein the ornamentation element is configured to extend away from the base anchoring element with only the base anchoring element and the attachment element being in contact with or directly adjacent to each other.

* * * * *